US005361829A

United States Patent [19]

Kreutzer et al.

[11] Patent Number: 5,361,829

[45] Date of Patent: Nov. 8, 1994

[54] CORRUGATED FIN FOR FLAT-TUBE HEAT EXCHANGERS

[75] Inventors: Josef Kreutzer; Kurt Mauch, both of Mühlacker, Germany

[73] Assignee: Behr GmbH & Co., Stuttgart, Germany

[21] Appl. No.: 986,473

[22] Filed: Dec. 7, 1992

[30] Foreign Application Priority Data

Dec. 19, 1991 [DE] Germany ..... 4142019

[51] Int. Cl.[5] ..... F28F 1/22

[52] U.S. Cl. ..... 165/152; 165/183

[58] Field of Search ..... 165/152, 153, 183

[56] References Cited

U.S. PATENT DOCUMENTS 3,265,127 8/1966 Nickol ..... 165/152
3,298,432 1/1967 Przyborowski ..... 165/153
3,993,125 11/1976 Rhodes ..... 165/153
4,535,839 8/1985 Sacca ..... 165/153
4,693,307 9/1987 Scarselletta ..... 165/152

FOREIGN PATENT DOCUMENTS 1868830 11/1962 Germany .
4031577 4/1992 Germany .

*Primary Examiner*—Allen J. Flanigan
*Attorney, Agent, or Firm*—Foley & Lardner

[57] ABSTRACT

An apparatus for a heat exchanger includes first and second flat tubes, a corrugated fin which is connected to and between said flat tubes and which is subjected to an air flow passing across the heat exchanger. The corrugated fin has a plurality of vanes or gills disposed transverse to the air flow direction and a stiffening bead formed thereon between two of the plurality of gills. The stiffening bead is disposed transverse to the air flow direction.

13 Claims, 2 Drawing Sheets

Fig. 1
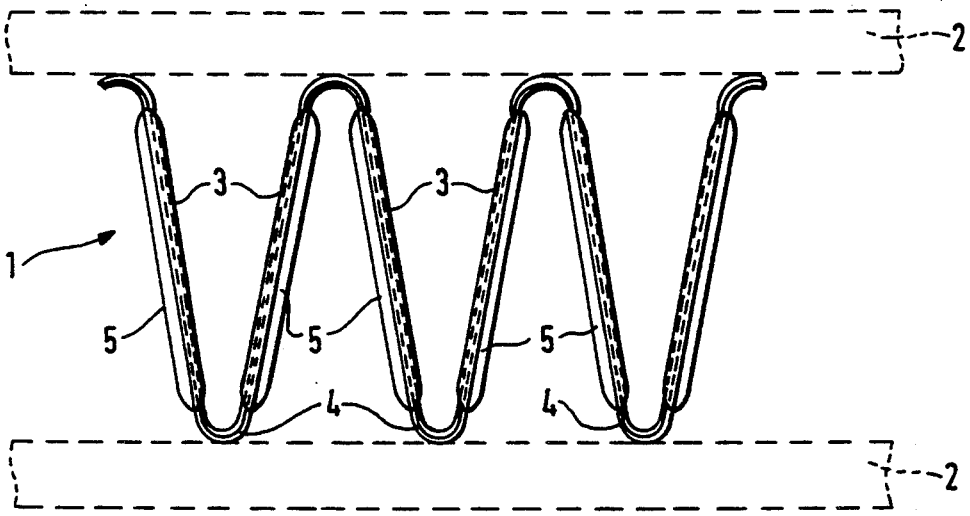
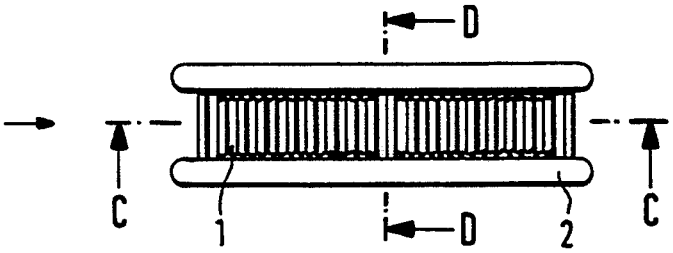
Fig. 2
Fig. 3
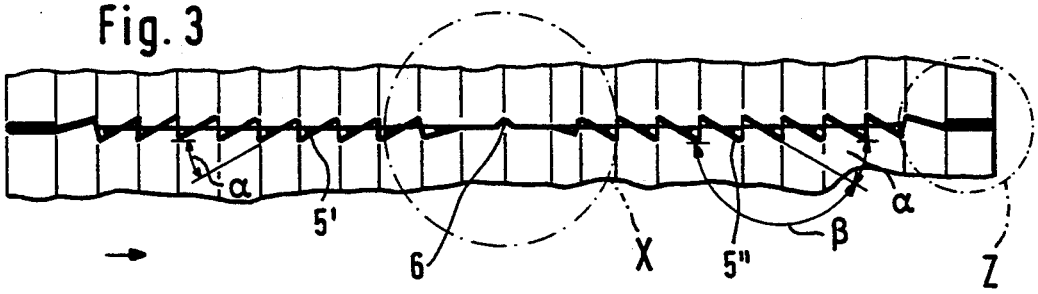
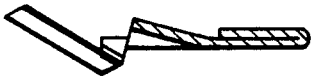
Fig. 4

CORRUGATED FIN FOR FLAT-TUBE HEAT EXCHANGERS

BACKGROUND OF THE INVENTION

1. Field of the Invention

The invention relates to a corrugated fin for a flat tube heat exchanger which is used, for example, in water/air radiators.

2. Description of the Related Art

In conventional water/air radiators for motor vehicles, corrugated fins are arranged between the flat tubes of the radiator and are soldered to the flat tubes. In addition to the function of transferring heat, these corrugated fins also perform a supporting function in that they prevent the flat tubes from bulging out when the flat tubes are subjected to internal pressure. Since the corrugated fins are made as thin as possible so that they have a high heat-transfer capacity, and are lightweight, a risk exists in that these corrugated fins will buckle under the pressure exerted by the flat tubes which tend to "inflate" when subjected to internal pressure. This problem is described in the applicant's previous application, P 40 31 577 (which is incorporated herein by reference), wherein the problem is solved by other means, namely the use of so-called supporting means between the flat tubes in the region of the tube bottoms.

SUMMARY OF THE INVENTION

An object of the present invention is to provide an improved corrugated fin of the type mentioned in the background, which does not buckle under the stress of the internal pressure of the flat tube and which at the same time, is lightweight, has a high heat-transfer capacity, and prevents the flat tubes from bulging out.

This object is achieved by providing an apparatus for a heat exchanger whereby the heat exchanger has an air flow passing across it in a predetermined direction. The apparatus includes first and second flat tubes, a corrugated fin which is connected to and between the flat tubes and which is subjected to the air flow. The corrugated fin has a plurality of vanes or gills disposed transverse to the predetermined direction of the air flow and a stiffening bead formed thereon between two of the plurality of vanes or gills. The stiffening bead is disposed transverse to the predetermined direction.

The arrangement of the stiffening bead which extends transversely relative to the longitudinal sides of the flat tubes ensures an appreciable stiffening of the corrugated fin and prevents the flat tube from bulging out under the stress of internal pressure. Consequently, the corrugated fin is prevented from buckling. The favorable arrangement and design of the stiffening bead ensures that there is no increase in the pressure drop in the air throughflow direction, and consequently no loss of capacity. Moreover, the weight and the thickness of the fin need not be changed. The shaping or embossing of the bead results in an increase in strength. That is, there is an increase in the buckling resistance of the corrugated fin because the flat tubes are now capable of withstanding a higher internal pressure than was possible without the use of a stiffening bead.

In a further embodiment of the invention, the stiffening bead is roof-shaped, extends over the entire width of the corrugated fin in a direction transverse to the air-flow direction, and is arranged in the middle region of the corrugated fin as viewed in the air-flow direction. The positioning of the stiffening bead in the middle region provides for the greatest effect, since the highest tension resulting from the bulging out of the flat tubes occurs at that position.

BRIEF DESCRIPTION OF THE DRAWINGS

An example of one preferred embodiment of the invention is described in more detail below and is illustrated in the drawings wherein:

FIG. 1 is a view of a corrugated fin disposed between flat tubes, as seen in the air-flow direction along sectional line D—D of FIG. 2.

FIG. 2 is a view of a corrugated fin disposed between flat tubes, as seen in the direction of the tube axes;

FIG. 3 is a sectional view taken through a corrugated fin along the sectional line C—C of FIG. 2;

FIG. 4 is an exploded view showing in detail the portion Z of FIG. 3;

DETAILED DESCRIPTION OF PREFERRED EMBODIMENTS

Figure 5:
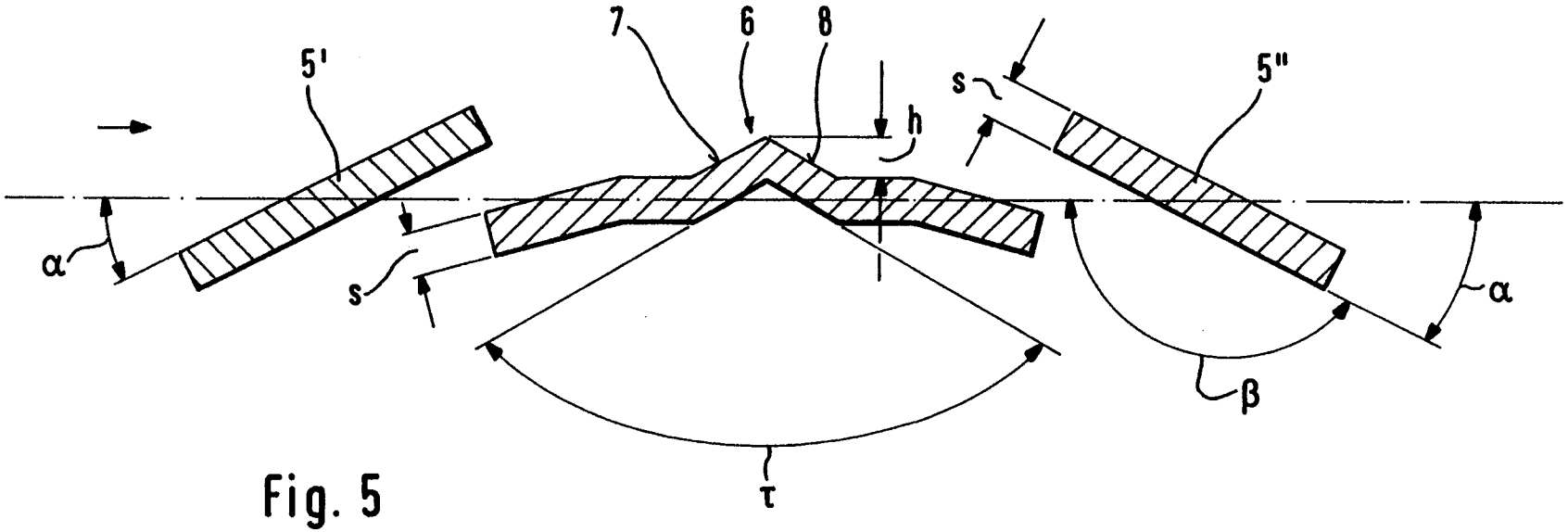
FIG. 5 is an exploded view showing in detail the stiffening bead of portion X of FIG. 3.

FIG. 1 illustrates a corrugated fin 1 which is located between flat tubes 2, represented by broken lines, of a heat exchanger which is not shown in any more detail, and which is preferably a water/air radiator for a motor vehicle driven by an internal-combustion engine. Cooling medium flows through the flat tubes 2 and, during operation, can be under a pressure of a plurality of bars. The corrugated fins 1 is subjected to ambient air and therefore dissipates the heat of the cooling medium to the external environment. For this purpose, the corrugated fin 1 is soldered to the outer wall of the flat tube 2 in a way that will guarantee an improved heat transfer between the flat tube 2 and the corrugated fin 1. The corrugated fin 1 is made substantially zigzag-like or concertina-like and has, on the one hand, planar regions 3, arranged at an angle relative to one another, and rounded regions 4, at which the corrugated fin is soldered to the flat tubes 2. Arranged in the planar regions 3 are vanes or gills 5 which are known per se and which serve to improve the transfer of heat from the corrugated fin 1 to the ambient air.

In FIG. 2, the arrangement of the corrugated fin 1 between the flat tubes 2 is shown diagrammatically as seen in the direction of the tube axes. Two sectional planes C—C and D—D are shown in FIG. 2. Accordingly, FIG. 1 is a sectional view along the plane D—D.

FIG. 3 shows a section through the corrugated fin 1 as viewed along the plane C—C. It can be seen that the corrugated fin 1 has a multiplicity of vanes or gills 5, as seen in the air-flow direction. The vanes or gills 5' of the first half of the corrugated fin each have a gill angle $\alpha$ and the vanes or gills 5'' of the second half of the corrugated fin also have a vane or gill angle $\alpha$ which is arranged directly opposite from the angle $\alpha$ of the vanes or gills 5', but which is of the same angular dimension. The angle $\beta$ is the angle which when added to the angle $\alpha$ produces an angle of 180°. According to the invention, there is provided in the middle region of the corrugated fin depth, a stiffening bead 6 which is shown in detail in FIG. 5, and which is described in more detail below. At the first and second ends of the corrugated fin 1, as viewed in the air-flow direction, the corrugated fin 1 is folded in a rounded manner as shown in the detail Z and reflected in FIG. 4. These folded rounded ends or hems of the corrugated fin 1 ensure a particularly good stiffening effect and a stabilization of the corrugated fin edges.

FIG. 5 shows in more detail the stiffening bead 6 and respective adjacent vanes or gills 5′ and 5″. The airflow as viewed in FIG. 5 moves from left to right in the direction of the arrow in the drawing, but it can just as easily take place from right to left, since the corrugated fin is constructed symmetrically in relation to its mid-axis. This is shown by the respective vane or gill angles $\alpha$ for the vanes or gills 5′ and 5″ which are arranged opposite to each other, but are of the same angular dimension. The angle $\alpha$ is approximately 30°. Angle $\beta$ is the complementary angle to the angle $\alpha$ relative to 180°. Between the two groups of vanes or gills 5′ and 5″, there is a vane- or gill-free region, in the middle of which the roof-shaped stiffening bead 6 is arranged. The stiffening bead 6 has two faces 7 and 8 which are inclined relative to one another in a roof-shaped manner, and which form an angle $\tau$ which can be in the region of approximately $180°-2\alpha$. This means that the faces 7 and 8 extend approximately parallel to the vane or gill faces 5′ and 5″. This roof-shaped design brings about virtually no increase in pressure loss in the airflow direction. The "ridge" of the roof-shaped stiffening bead 6 rises by an amount h slightly above the plane of the fin surface. The thickness of the fin is designated by the dimension s and is approximately 0.1 mm. The fin is preferably produced from an aluminum alloy. The height h is approximately 1 to 2.5 times the fin thickness s. The stiffening bead 6 is produced by means of a simple embossing operation, during the manufacture of the fin when the fin is run through the fin rollers, and therefore necessitates no special outlay.

The operating mode of the stiffening bead 6 becomes especially clear by looking at FIG. 2 where the stiffening bead 6 is located in the region of the sectional plane D—D. When the flat tubes 2 attempt to inflate in their middle region as a result of the stress of internal pressure, the stiffening bead 6 provides an increased resistance to this deformation process in this region, so that an inflation of the tubes 2 and an associated buckling of the corrugated fin 1 are prevented. By means of this simple measure which entails virtually no disadvantages, the supporting effect of the corrugated fin can be increased, and consequently, in order for the corrugated fin to buckle, a much higher internal pressure in the flat tubes is required as compared to the prior art devices.

While several embodiments of the invention have been described, it will be understood that further modifications are still capable, and this application is intended to cover any variations, use or adaptation of the invention and including such departures from the present disclosure as to come within the scope of the invention and the limits of the appended claims.

What is claimed is:

1. A heat exchange apparatus comprising:

first and second flat tubes;

a corrugated fin connected to and between said flat tubes, said corrugated fin having a plurality of gills disposed transverse to a longitudinal direction of said corrugated fin, a gill-free region in a middle portion of said corrugated fin, said gill-free region including a stiffening bead integrally formed therein transverse to said longitudinal direction and extending over the entire width of said corrugated fin between said flat tubes, said stiffening bead formed as a roof-shape with first and second legs.

2. A heat exchange apparatus as recited in claim 1, wherein said gill-free region further comprises first and second planar surfaces which are respectively contiguous with said first and second legs such that first and second folds are respectively defined at an interface of said first planar surface and said first leg and an interface of said second planar surface and said second leg, thereby providing increased stiffness to said stiffening bead.

3. A heat exchange apparatus as recited in claim 2, wherein said gill-free region further comprises third and fourth planar surfaces which are respectively contiguous with said first and second planar surfaces such that third and fourth folds are respectively defined at an interface of said first and third planar surfaces and at an interface of said second and fourth planar surface.

4. An apparatus as recited in claim 1, wherein said stiffening bead is disposed approximately in a middle of said corrugated fin relative to a dimension of the corrugated fin as measured along said longitudinal direction.

5. An apparatus as recited in claim 4, wherein said stiffening bead is embossed on said corrugated fin.

6. An apparatus as recited in claim 3, wherein 1) said corrugated fin has first and second halves as measured along said dimension, 2) a first set of said plurality of gills are disposed at an angle $\alpha$ on the first half, 3) a second set of said plurality of gills are disposed at an angle $\beta=180°-\alpha$ on the second half, 4) said angles $\alpha$ and $\beta$ are each measured in said longitudinal direction, and 5) said stiffening bead has a cross-section such that an angle $\tau$ which is approximately equal to $180°-2\alpha$ exists between said first and second legs of said stiffening bead.

7. An apparatus as claimed in claim 6, wherein said stiffening bead has a height h, said corrugated fin has a thickness s, and $s<h<2.5$ s.

8. An apparatus as recited in claim 4, wherein 1) said corrugated fin has first and second halves as measured along said dimension, 2) a first set of said plurality of gills are disposed at an angle of $\alpha$ on the first half, 3) a second set of said plurality of gills are disposed at an angle $\beta=180°-\alpha$ on the second half, 4) said angles $\alpha$ and $\beta$ are each measured in said longitudinal direction, and 5said stiffening bead has a cross-section such that an angle $\tau$ which is approximately equal to $180°-2\alpha$ exists between said first and second legs of said stiffening bead.

9. An apparatus as claimed in claim 8, wherein said stiffening bead has a height h, said corrugated fin has a thickness s, and $s<h<2.5$ s.

10. An apparatus as recited in claim 1, wherein 1) said corrugated fin has first and second halves as measured along said dimension, 2) a first set of said plurality of gills are disposed at an angle $\alpha$ on the first half, 3) a second set of said plurality of gills are disposed at an angle $\beta=180°-\alpha$ on the second half, 4) said angles $\alpha$ and $\beta$ are each measured in said longitudinal direction, and 5) said stiffening bead has a cross-section such that an angle $\tau$ which is approximately equal to $180°-2\alpha$ exists between said first and second legs of said stiffening bead.

11. An apparatus as claimed in claim 10, wherein said stiffening bead has a height h, said corrugated fin has a thickness s, and $s<h<2.5$ s.

12. An apparatus as recited in claim 1, wherein said stiffening bead is embossed on said corrugated fin and extends over the entire width of said corrugated fin between said flat tubes.

13. A heat exchange apparatus comprising:

first and second flat tubes through which water flows;

a corrugated fin connected to and between said flat tubes through which water flows, said corrugated fin having a plurality of gills disposed transverse to a longitudinal direction of said corrugated fin, a gill-free region in a middle portion of said corrugated fin, said gill-free region including a stiffening bead integrally formed therein transverse to said longitudinal direction and extending over the entire width of said corrugated fin between said flat tubes, said stiffening bead formed as a roof-shape with first and second legs.

* * * * *